US006832740B1

(12) United States Patent
Ransom

(10) Patent No.: US 6,832,740 B1
(45) Date of Patent: Dec. 21, 2004

(54) MISSILE SYSTEM AND METHOD OF MISSILE GUIDANCE

(75) Inventor: Richard Sutton Ransom, Holywood (GB)

(73) Assignee: Short Brothers PLC (GB)

( * ) Notice: Subject to any disclaimer, the term of this patent is extended or adjusted under 35 U.S.C. 154(b) by 1826 days.

(21) Appl. No.: 07/012,615

(22) Filed: Jan. 16, 1987

(51) Int. Cl.[7] ..... F41G 3/00
(52) U.S. Cl. ..... 244/3.13; 244/3.15; 102/489
(58) Field of Search ..... 102/489; 244/3.13, 244/3.11, 3.16, 3.15; 89/1.11

(56) References Cited

U.S. PATENT DOCUMENTS 4,372,216 A * 2/1983 Pinson et al. ..... 102/489
4,394,997 A * 7/1983 Maudal ..... 244/3.16
4,417,520 A * 11/1983 Maudal ..... 102/489
4,455,943 A * 6/1984 Pinson ..... 102/489
4,625,646 A * 12/1986 Pinson ..... 102/489
4,638,737 A * 1/1987 McIngvale ..... 102/489

* cited by examiner

*Primary Examiner*—Jack Keith
*Assistant Examiner*—Gabriel Sukman
(74) *Attorney, Agent, or Firm*—Venable; Jeffri A. Kaminski

(57) ABSTRACT

A missile system and a method of missile guidance in which a bus missile is launched from a launch station remote from a target with the bus missile carrying a plurality of sub-missiles. The sub-missiles are then launched from the bus missile during flight of the bus missile. The sub-missiles are arranged to deploy ahead of the bus missile and are guided to the target under the control of a guidance beam generated in and transmitted from the bus missile.

27 Claims, 11 Drawing Sheets

MISSILE SYSTEM AND METHOD OF MISSILE GUIDANCE

The present invention relates to missile systems and is particularly concerned with a missile system in which a bus missile carrying a plurality of sub-missiles is launched from a launch station remote from a target and the sub-missiles launched from the bus missile during flight of the bus missile.

Efforts are constantly being made to provide naval vessels with defensive systems capable of dealing with anti-ship missiles and particular attention has been directed to defensive systems against missiles which fly at low level and at low supersonic speed. As a consequence of this, a requirement now exists to provide a missile system which can be used effectively against naval vessels equipped with such defensive systems.

It is accordingly one object of the present invention to provide a missile system which has a better prospect of penetrating naval vessel defense systems mounted against it and to a method of missile guidance for this purpose.

It is furthermore another object of the present invention to provide a missile system for use in anti-missile engagements, ranging from engagements against low flying missiles such as cruise and sea-skimming missiles to engagements against long range high trajectory missiles.

According to a first aspect of the present invention there is provided a missile system comprising a bus missile, bus missile guidance means for guiding the bus missile toward a target from a launch station remote from the target, a plurality of sub-missiles carried by the bus missile, sub-missile launch means to launch the sub-missiles from the bus missile during flight of the bus missile whereby they deploy ahead of the bus missile and a sub-missile guidance beam generating means within the bus missile for generating and transmitting a sub-missile guidance beam to guide the sub-missiles to the target.

Preferably, the sub-missiles are guided to the target in a predetermined but variable spatial pattern.

Preferably, the bus missile includes a sustainer motor for sustaining flight of the bus missile to the target and the sustainer motor of the bus missile is such as to bring the missile to and sustain it at a predetermined low supersonic speed.

In a preferred embodiment of the invention hereinafter to be described the bus missile includes a booster motor for accelerating the bus missile during a final acceleration phase when it closes to a predetermined range from the target. Preferably, the booster motor is such as to accelerate the bus missile during the final acceleration phase to a speed of at least twice the mid-course speed.

The sub-missile launch means is preferably operative to launch the sub-missiles at the end of the final acceleration phase.

In an embodiment of the invention hereinafter to be described flight direction control means of the bus missile are made responsive to a predetermined control signal to cause the bus missile to climb to an increased altitude during the final acceleration phase and the sub-missiles are launched at the increased altitude and on a rising trajectory.

In an embodiment of the invention hereinafter to be described the sub-missile guidance beam is a pulsed laser beam providing a scan with respect to a scan axis coincident with the longitudinal axis of the bus vehicle and extending forwardly thereof to provide within an area scanned by the beam a pulse and space modulation sufficient to identify coordinates of any point within the scanned area and each sub-missile includes a receiver for generating control signals for application to flight direction control means of the sub-missile to bring the sub-missile to a selected one of a plurality of spaced sub-missile stations within the scanned area. The sub-missile flight direction control means would normally comprise aerodynamic control surfaces although thrusters may be needed where the missile system is used in space.

In a preferred embodiment of the invention hereinafter to be described, the bus missile comprises a body portion which is caused to rotate during flight, and the sub-missiles are mounted on the body portion of the bus missile. The sub-missiles upon release at launch then deploy radially outwardly from the body portion under centrifugal force.

For a variety of situations, the sub-missile may conveniently take the form of a guided non-power-driven sub-missile. In this event the drag characteristic of each sub-missile relative to the drag characteristic of the bus missile is made such that the sub-missile when launched from the bus missile deploys ahead of the bus missile.

The bus missile guidance means will normally comprise command guidance means located at the bus missile launch station for mid-course flight guidance of the bus missile to the target and in a preferred embodiment of the invention homing guidance means is provided to take up guidance of the bus missile at predetermined range from the target.

In a specific embodiment of the invention hereinafter to be described, the bus missile includes a nose portion rotatable with respect to the body portion and roll attitude control means for controlling the roll attitude of the nose portion during flight of the bus missile. The roll attitude control means is preferably operative to maintain the nose portion roll stabilised in flight.

In the embodiment of the invention hereinafter to be described the sub-missile guidance beam generating means and the homing guidance means are located within the nose portion of the bus missile.

According to a second aspect of the present invention there is provided a method of missile guidance comprising the steps of launching a bus missile from a launch station remote from a target with the bus missile carrying a plurality of sub-missiles, launching the sub-missiles from the bus missile during flight of the bus missile whereby the sub-missiles deploy ahead of the bus missile and guiding the missiles to the target under the control of a guidance beam generated in and transmitted from the bus missile.

Preferably, the sub-missiles are guided to the target in a predetermined but variable spatial pattern.

Preferably, in the method according to the second aspect of the invention, the missile is sustained during mid-course flight at a predetermined low supersonic speed and is accelerated during a final acceleration phase to a speed of at least twice the mid-course speed when it closes to a predetermined range from the target. The sub-missiles are then launched from the bus missile upon completion of the final acceleration phase of the bus missile.

In use, as an anti-ship missile system, for example, the bus vehicle can be launched from an attack ship or other launch platform at extended range from the target to be attacked. The bus vehicle may be vertically or directionally launched according to the means chosen. The bus vehicle is then guided toward the target usually, but not essentially, at low supersonic speed and at low level to avoid detection. It is contemplated that in preferred embodiments, at some predetermined distance from the target which is ideally but not essentially outside the range of ship defence systems capable of engaging the known threat from slow and low-flying missiles, the bus missile is accelerated to a significantly higher speed and a rising flight path. During this trajectory, it releases the sub-missiles which are guided towards the target along a guidance beam generated within and transmitted from the bus vehicle. The salvo of small sub-missiles is then directed in a pre-arranged pattern along the beam toward the target, presenting a very difficult defence problem.

The missile system as hereinafter to be described with reference to the drawings may with particular advantage be used in anti-ship engagements, with the bus missile being launched from another naval vessel. It will however be appreciated that the missile system and the method of missile guidance according to the invention may also be used in other combat situations.

Clearly, the missile system according to the invention may be used in surface-to-air and air-to-air engagements. It may with advantage be used in anti-missile engagements, for example against low flying missiles, such as cruise or sea skimming missiles or against long range high trajectory missiles.

In air-to-ground engagements, for example, the bus missile could be launched by an attacking aircraft and initially guided to the target under command guidance control. Once the bus missile comes under homing control the aircraft is free to take evasive action and to attack other targets. The missile system according to the invention could be utilised for combat in space, although clearly rocket thrusters would be needed for guidance of the bus missile and the sub-missiles launched from it.

An embodiment of the invention will now be described by way of example with reference to the accompanying drawings in which:

FIG. 1 is a schematic part-sectional side elevation of a bus missile carrying a plurality of sub-missiles and forming part of a missile system according to the invention;

FIGS. 2*a* and 2*b* are sectional scrap views of the bus missile shown in FIG. 1, drawn to an enlarged scale and illustrating the launching mechanism for the sub-missiles;

Figure 1:
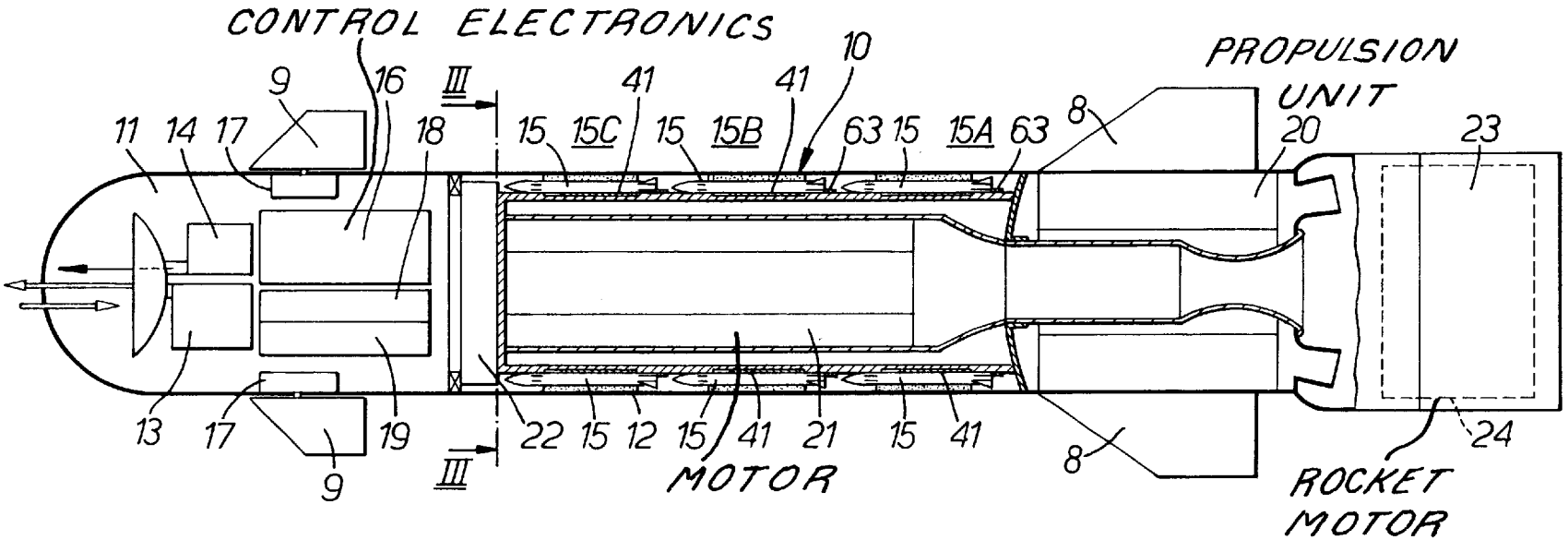

Referring first to FIG. 1, a bus vehicle 10 is shown which can be regarded as being constituted of three major parts as follows:

1) A nose portion 11, which is rotationally uncoupled from a body portion 12 and which contains an active homing head 13, a laser beam generator 14 collimated to the homing head 13 and effective to produce a guidance beam to guide each one of a plurality of sub-missiles 15, when they are released from the bus vehicle 10. Other items in the nose portion 11 are the processing and control electronics 16, actuators 17 for aerodynamic control surfaces 9, a signal receiver 18 and a power supply 19.

2) A body portion 12, which contains two propulsion units, namely a sustainer rocket motor 20 to sustain the mid-course and terminal flight velocity of the bus vehicle 10 and a boost rocket motor 21 to accelerate the bus vehicle 10 for the final phase. Distributed around the motor 21 are the sub-missiles 15. These are arranged as shown in three circumferential groups 15A,15B,15C each of 12 missiles, making 36 in all, although a greater number of, say, 60 or lesser number could be carried, if so desired. The body portion 12 includes an ignition safety and arming mechanism 22 to control the firing of the propulsion units 20,21 and the release of the sub-missiles 15.

3) A tail portion 23, which comprises a launch rocket motor 24 which serves as a launch propulsion unit. The tail portion 23 is arranged to separate from body portion 12 of the bus vehicle 10 and fall away from it soon after launch of the bus vehicle and when the motor 24 becomes exhausted. The launch rocket motor 24 will require means to control the direction of flight during the launch phase particularly in the case of vertical launch. A thrust vector control may be used for this purpose.

In use, the bus missile 10 is launched from its launch station (e.g. a naval vessel) as soon as a target has been identified and the decision to attack has been taken. The launch may be vertical from a fixed launcher (which affords simplified accommodation of the system on a ship) or directional from either a fixed or trainable launcher. The bus missile 10 is then accelerated by the sustainer motor 20 to a speed of about Mach 1.5 and is controlled to fly at low altitude in order to minimise detection by radar or other means. Command guidance equipment at the launch station initially directs the bus missile 10 toward the target but during mid-course flight the homing head 13 carried in the bus vehicle 10 takes command and directs the vehicle 10 toward the target. Speed is maintained during this period by the sustainer motor 20 carried in the body portion 12 of the vehicle 10.

At a predetermined distance from the target the control electronics 16 produce ignition of the boost motor 21 which accelerates the vehicle 10 to a speed of about Mach 3.5. The control electronics 16 also command the actuators 17 to cause the vehicle 10 to climb in altitude, so as to reach its maximum speed at relatively higher altitude and at a range of, for example, 8–10 Km from the target. At the point of exhaustion of the boost motor 21, a release mechanism in the body portion 12 becomes effective to release the sub-missiles 15 from the bus vehicle 10. At the same time, the electronics 16 also activate the laser beam transmitter 14. The bus vehicle 10 then decelerates due to completion of the boost phase.

The bus missile 10 remains in stable flight with the homing head 13 locked on to the target so that the collimated laser beam generated by the transmitter 14 is directed at the target. The sub-missiles 15, due to their lower drag characteristics, overtake the bus missile 10 and take up individually programmed stations within the modulated laser beam as they proceed towards the target.

The bus missile 10 remains in stable flight with the homing head 13 determining the direction of the laser beam to illuminate the target. The sub-missile stations within the beam are chosen to maximise damage to the target, e.g. the probability of striking sensors and weapon systems vital to the defence of the ship. This would render the target vulnerable to attack by larger unitary warhead missiles which, otherwise, it would have a better likelihood of resisting effectively.

Figure 2A:
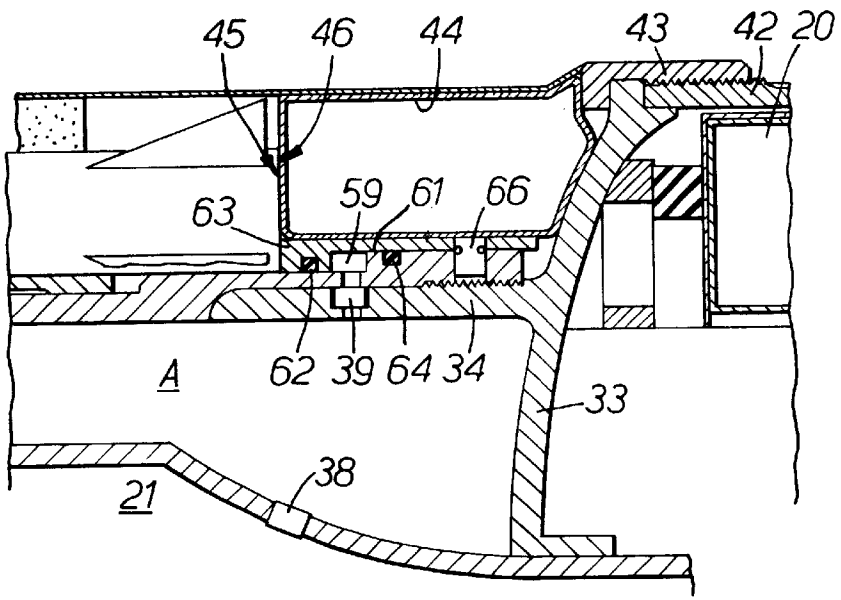
Figure 2B:
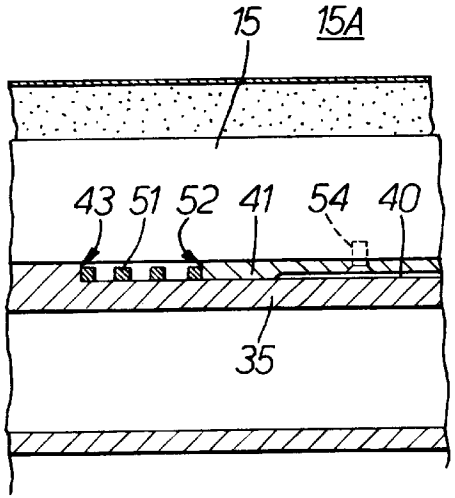
Figure 2B:
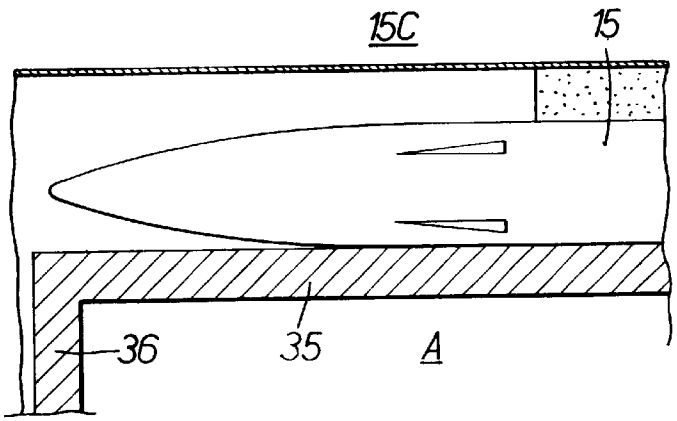
Figure 3:
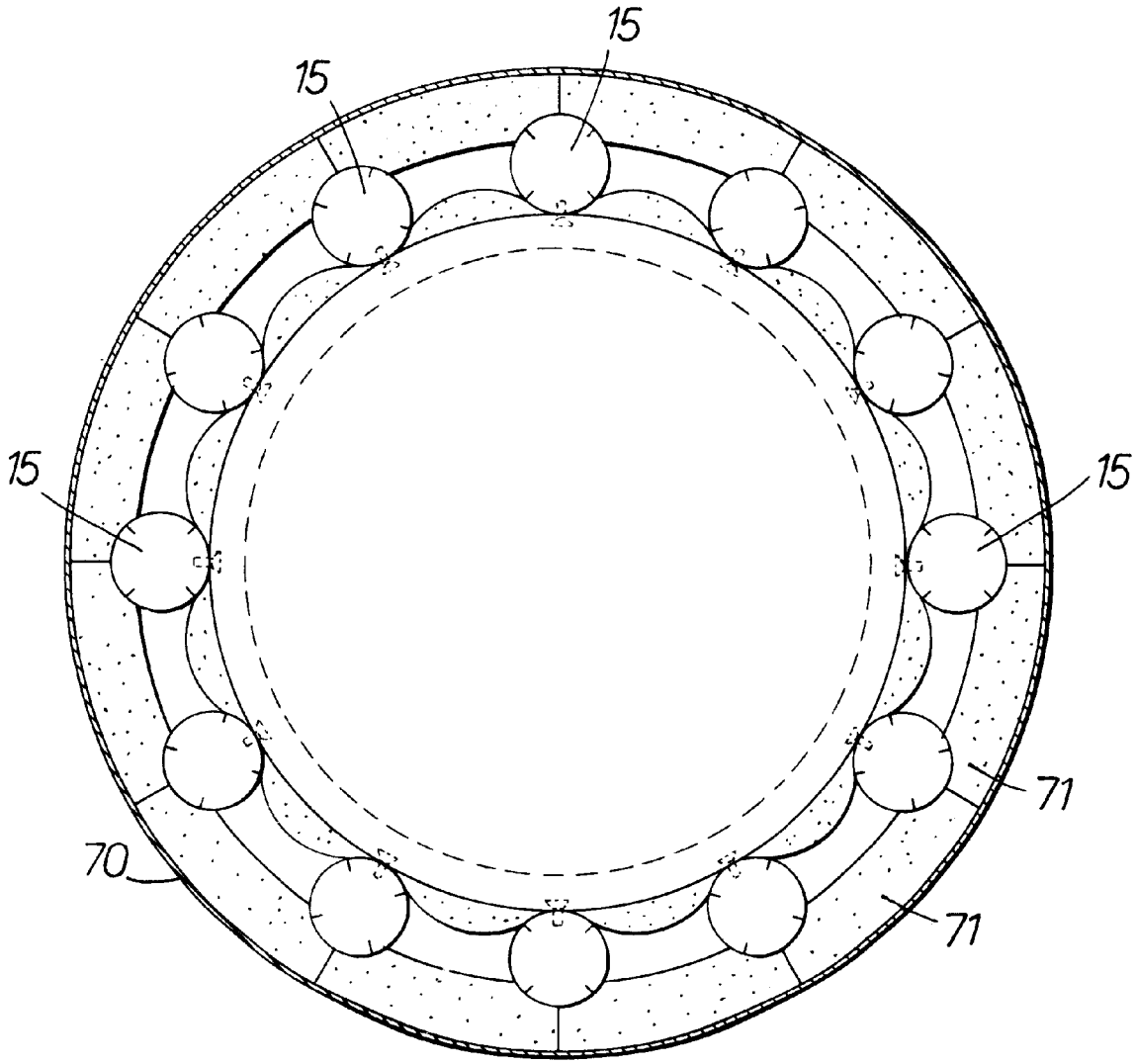
FIG. 3 is a schematic section of the bus missile shown in FIG. 1, taken on the line III—III in FIG. 1.

A release mechanism for releasing the sub-missiles 15 is shown in FIGS. 2*a*,2*b* and 3. As will be seen from FIGS. 2*a* and 2*b*, at the front of the sustainer motor 20 is a light alloy motor head piece 33 held to the casing 42 of the motor 20 by a threaded collar 43. The head piece 33 carries a hollow, sub-missile abutment and fairing structure 44 which has a plurality of forward-facing abutment faces 45 which are abutted by the rear faces 46 of the sub-missiles 15. An axial spigot part 34 on the head piece 33 carries a support cylinder 35 which extends along the length of the body portion 12 of the bus missile and terminates in a closed end 36. The spigot 34 bounds a pressure reservoir chamber A, closed by the cylinder 35. When the booster motor 21 is ignited, the chamber A becomes filled with compressed gases from the propellent material by passage of these gases through a non-return valve 38 in the casing of the motor 21. The structure of the non-return valve 38 is not shown, but it is of the "pastille" type.

The cylinder 35 has on its cylindrical surface an annular recess 40, on which is slidable axially, but not rotatably, a sleeve 41 upon which the sub-missiles 15 of the group 15A are carried, each being secured to it by a shear pin fastener 54. The sub-missiles 15 are equi-angularly disposed around the circumference of the sleeve 41, as shown in FIG. 3. A helical spring biasing means 51 is housed in the space between the cylinder 35 and the sleeve 41 between the end surface 43 of the recess 40 and a forward facing abutment surface 52 of the sleeve 41.

The cylinder 35 is provided with a further sub-missile abutment structure for each group of sub-missiles 15B and 15C and carries two further sleeves corresponding to the sleeve 41 upon which the sub-missiles 15B and 15C are carried and secured in like manner by shear pins. For the present description, only the release mechanism for the sub-missiles of group 15A will be described, but it will be understood that identical mechanisms are provided for the release of the sub-missiles 15B and 15C.

Referring again to FIG. 2*a*, a plurality of apertures 39 through the support cylinder 35 and the spigot 34 permit passage of the propellent gases to a gas pressure chamber 59 bounded by a working annulus 60 of a piston 61 and the cylinder 35. A first O-ring 62 on the head end 63 of the piston and a second O-ring 64 on the external surface of the cylinder 35 maintain the working space 59 gas-tight. The head end 63 of the piston is in contact with the rearward-facing surface 46 of the sub-missile 15 and a shear pin restraining means 66 resists relative movement of the piston 61 on the annular external surface of the cylinder 35.

After launch of the bus missile, compressed propellent gases enter the working space 59 to generate a catapult force on the piston 61, but the combination of inter alia (i) the shear resistance of the shear pin 66, (ii) the reaction R of the twelve sub-missiles, the sleeve 41 and the piston 61, to the thrust of the boost motor 21 on the head end 63 of the piston 61 and iii) the biasing force of the spring 51, is effective to prevent the gas pressure from driving the sub-missiles 15 forwardly relative to the support cylinder 35, but only for as long as the boost motor 21 is delivering full thrust, i.e. generating acceleration of the sub-missiles 15, sleeve 41 and piston 61, and the reaction force R.

Release of the sub-missiles 15 is required at the time of maximum velocity of the bus missile, at the moment when the boost motor 21 is all-burnt. When the thrust from the motor 21 falls off, there is a consequent decline in the force of reaction R on the head end 63 of the piston 61 (although drag forces on the sub-missiles will provide some residual pressure on the piston). The catapult force F on the piston 61, arising from the accumulated pressure of gas in the working space 59, is now high enough for the piston 61 to shear the shear pin 66 and drive the piston forward, in turn driving forward the assembly of the sleeve 41 and sub-missiles 15. This forward movement compresses the helical spring 51 up to the point when the turns of the spring abut each other. No substantial further compression occurs and there is rapid deceleration of the sleeve 41 on the cylinder 35. This rapid deceleration of the sleeve 41, and continuing pressure of the head 63 of the piston on the sub-missiles 15, brings about shearing of the shear pins 54, thereby severing the connection between the sub-missiles 15 and the sleeve 41. The forward movement of the sub-missiles which takes place between shearing of the pin 66 and the pins 54 can therefore be seen as a forward movement from a flight disposition to a launch disposition.

In an alternative arrangement which does not include a shear pin 66, the catapult force F is resisted by the pinning force P, up to the breaking stress of the shear pin 54, the reaction R of the sub-missiles 15 to acceleration of the bus missile, and any drag forces acting on the sub-missiles. The mass of the sub-missiles 15 is large relative to that of the sleeve 41. In such an arrangement, the forward movement to the launch disposition, and compression of the spring 51, is considered to occur during the phase of acceleration of the bus missile. At the end of the period of acceleration there is no further forward movement of the sleeve 41, but the decline in the reaction force R results in shearing of the pins 54 and forward discharge of the sub-missiles 15.

The body portion 12 of the bus missile 10 spins during flight and the spinning motion endows the sub-missiles 15 with a tendency to accelerate outwardly away from the longitudinal axis of the bus missile 10 at the moment of fracture of the shear pins 54. Optimum release is achieved when the shear pins 54 are located level with the centre of gravity of the sub-missiles 15 along their length.

The sleeve 41 can be replaced by a cradle supported in a way which allows limited radially outward acceleration, e.g. up ramps, during the forward movement to the launch disposition, for endowing the sub-missiles 15 with an acceleration radially outwardly which supplements the acceleration due to spinning or provides acceleration in a case where the bus missile 10 is not spinning.

FIG. 3 shows a protective outer skin 70 and restraining blocks 71 of expanded polystyrene or other extremely lightweight material, which skin and blocks are caused to fall away from the sub-missiles 15 at some point before the boost motor 21 becomes all-burnt but which, up to that point in the flight of the missile, serve to protect the sub-missiles 15 from accidental damage and, during the early part of the flight of the missile, afford aerodynamic streamlining of the bus missile. Present indications are that such streamlining is, however, not essential, so the skin and blocks could be dispensed with.

Upon release from the bus missile 10, the sub-missiles 15 deploy ahead of the bus missile and are guided to the target under the control of a laser guidance beam generated in and transmitted from the bus missile by the laser beam generator 14. A generator suitable for use as the generator 14 will now be described with reference to FIGS. 4 to 6 and FIGS. 7 to 10.

Figure 4:
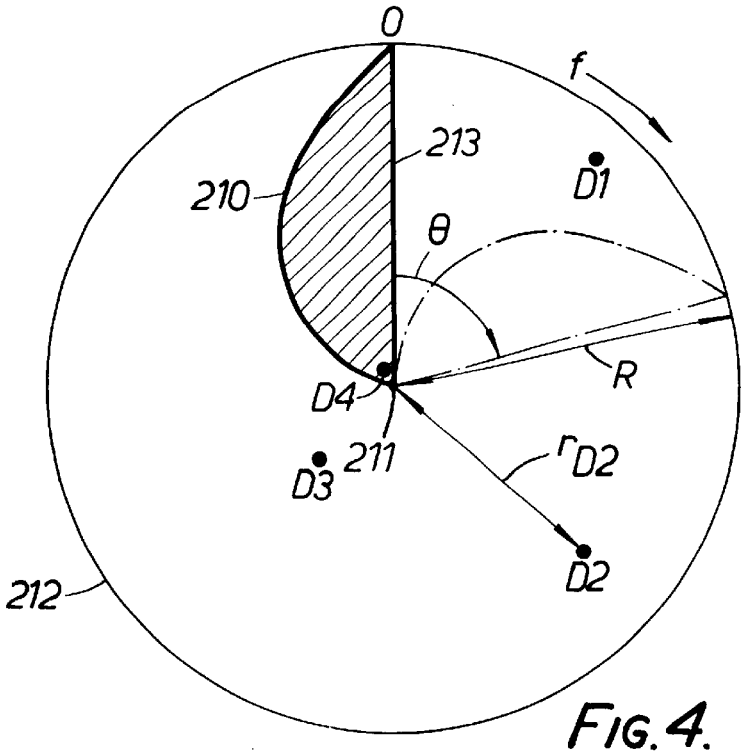
FIG. 4 is a diagram illustrating a sub-missile guidance beam generated within and transmitted from the bus missile shown in FIG. 1.
Figure 5:
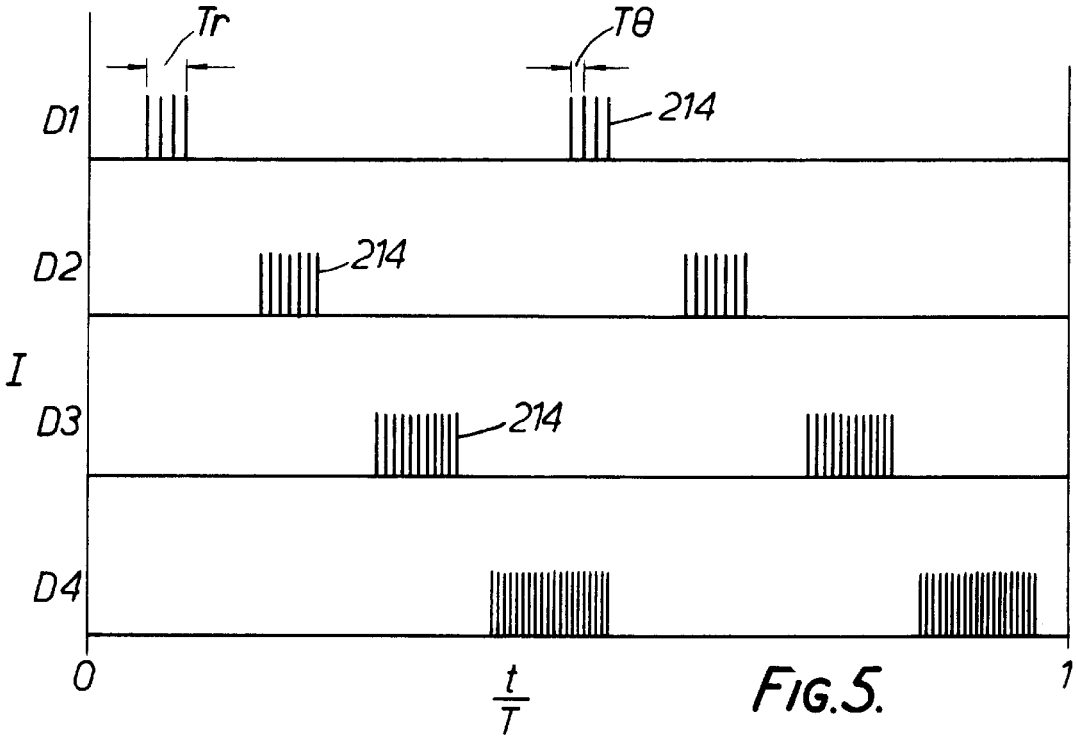
FIG. 5 is a graph of received beam intensity of the beam shown in FIG. 4 against time, expressed as one cycle of revolution of the beam, for four points shown in FIG. 1, the graph indicating the form of the beam as it is incident upon each of the four points.

With reference first to FIGS. 4 and 5, and in particular FIG. 4, spatial modulation of a sub-missile guidance beam may be achieved by:

(1) rotating a laser beam 210 of the cross-section shown in a direction f about a central axis 211 to produce a circular control pattern area 212 having radius R, (2) pulsing the laser beam at a frequency which varies with its angular displacement (e.g. θ after time t) from a vertical or other reference direction 213 in the plane of the control pattern. Each revolution of the laser beam 210 takes time T. During it, the pulse repetition frequency (or pulse interval) is varied between two limits, and the cycle is continually repeated at a pre-determined rate. Measurement by a sensor D of the time interval $T_\theta$ between received laser pulses provides a measure of the position of the sensor in terms of an angular displacement θ from the reference direction 213, (3) so shaping the control beam that the total time Tr during which a sensor receives electromagnetic waves per revolution of the beam pattern provides a measure of the position of the sensor in terms of a radial displacement r from the axis of rotation 211 of the beam. The beam 210 is so shaped that during rotation thereof at a steady angular velocity w, the proportion Tr of the total time T for one revolution of the beam during which laser radiation is incident upon a point varies strictly linearly with the radial distance r of that point from the rotational axis 211 of the beam 210, and varies from 25% for a point just off the axis of the beam to 0% for a point on the very edge of the beam. This has been termed a "rotating leaf" beam modulation system.

FIGS. 4 and 5 together illustrate schematically the variation in a series of electromagnetic (laser) pulses 214 received for various sensor positions (D1, D2, D3 and D4) within the area 212 controlled by the beam 210.

Figure 6:
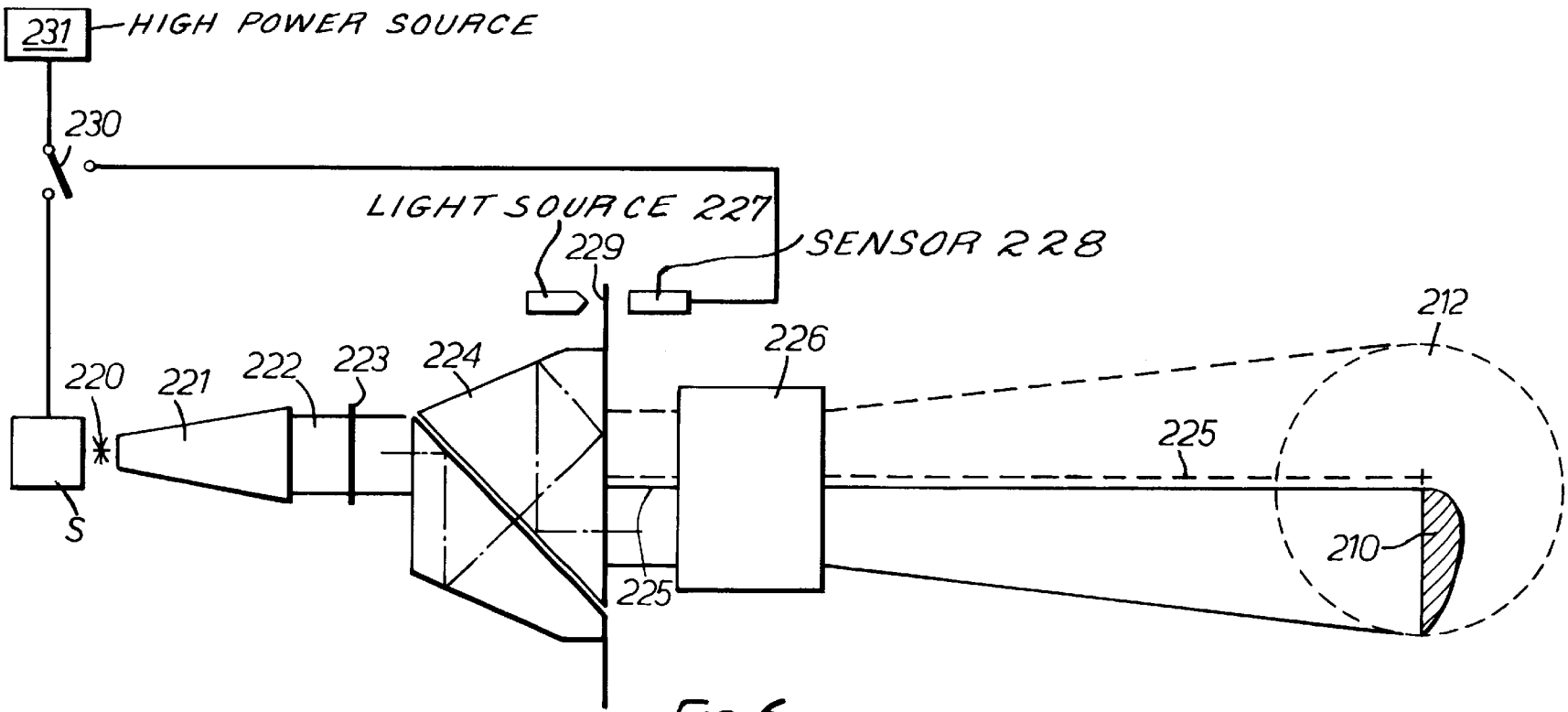
FIG. 6 is a schematic side view of a beam generator for generating the sub-missile guidance beam illustrated in FIG. 4.

Referring now to FIG. 6, a laser beam generator is shown which comprises a divergent laser source S providing a laser beam 220 which is collimated by a fibre optic integrating system 221. Alternatively the diverging beam can be collimated by a collimating lens, the collimated beam being partially diffused by a diffusing plate or optical scrambler rod.

The resultant substantially parallel beam 222 is then passed through a fixed shaped aperture 223 which is provided in a housing (not shown) which has an interior matt black finish. The shape of the aperture 223 corresponds to the shape of the transmitted laser beam 210.

Arranged in front of the fixed aperture 223 is a beam rotation optical system 224 (in this case a pechan prism) which is driven by a motor (not shown) so as to rotate the shaped beam normally at a constant angular velocity on an axis 225 passing through the centre of the beam rotation optical system and one end of the aperture. The beam then passes to a main optical system indicated by a zoom lens 226 which focuses the laser beam as required. The lens is of the "flick on" type, in that it features step changes in optical gain to match what would be expected for the maximum and minimum optical gain of a normal zoom lens.

A laser trigger mechanism linked to the beam rotation system pulses the laser as the beam is rotated. The laser trigger consists of a light source 227 and light sensor 228. The light transmitted by the source 227 is modulated by a pulsing pattern comprising alternate opaque and transparent regions provided around the periphery of a reticle 229 mounted to the beam rotation system. The sensor produces, in response to the pulsed light signals, a pulsed output signal which triggers a solid state switch 230 to intermittently connect a source 231 of high power to the laser source to produce corresponding pulses of the laser beam. A progressive increase or decrease in the width of the opaque areas around the circumference of the reticle will produce during each rotation an increase or decrease in the time interval between pulses of the laser beam within an upper and lower limit.

Figure 7:
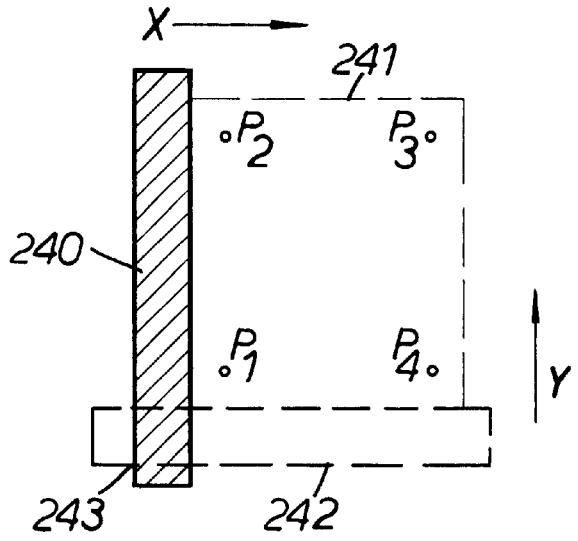
FIG. 7 is a diagram of a sub-missile guidance beam in cross-section illustrating beam components X and Y and identifying four points within the cross-section scanned by them.

With reference now to FIGS. 7 to 10 of the drawings and in particular FIG. 7, spatial modulation of the control pattern cross-section may alternatively be achieved by (1) sweeping a first beam component 240 across a rectangular control pattern area 241 in a first scanning direction X and at a first scanning frequency (No. of scans in unit time), (2) sweeping a second beam component 242 across the same control pattern area 241 in a second scanning direction Y which is perpendicular to direction X and at the same scanning frequency, the scans of the second beam component 242 being arranged to illuminate points within the control pattern area 241 at times which alternate with the times of illumination of the point by the first beam component 240, and (3) pulsing each beam component at a frequency which varies with its displacement (x or y) from the origin 243 of the X, Y scanning axes in the plane of the control pattern. During each sweep of a beam component, the pulse repetition frequency (or pulse interval) is varied between two limits, with alternate sweeps preferably possessing different limits and non-overlapping ranges, and the two sweep cycles being continually repeated at a predetermined rate.

A sensor is actuated by laser radiation of the pulse train of each sweep of a beam component. Measurement by the sensor of the time intervals (Tx, Ty) between received laser pulses in two consecutive pulse trains provides a measure of the position of the sensor relative to mutually perpendicular reference axes.

Figure 8:
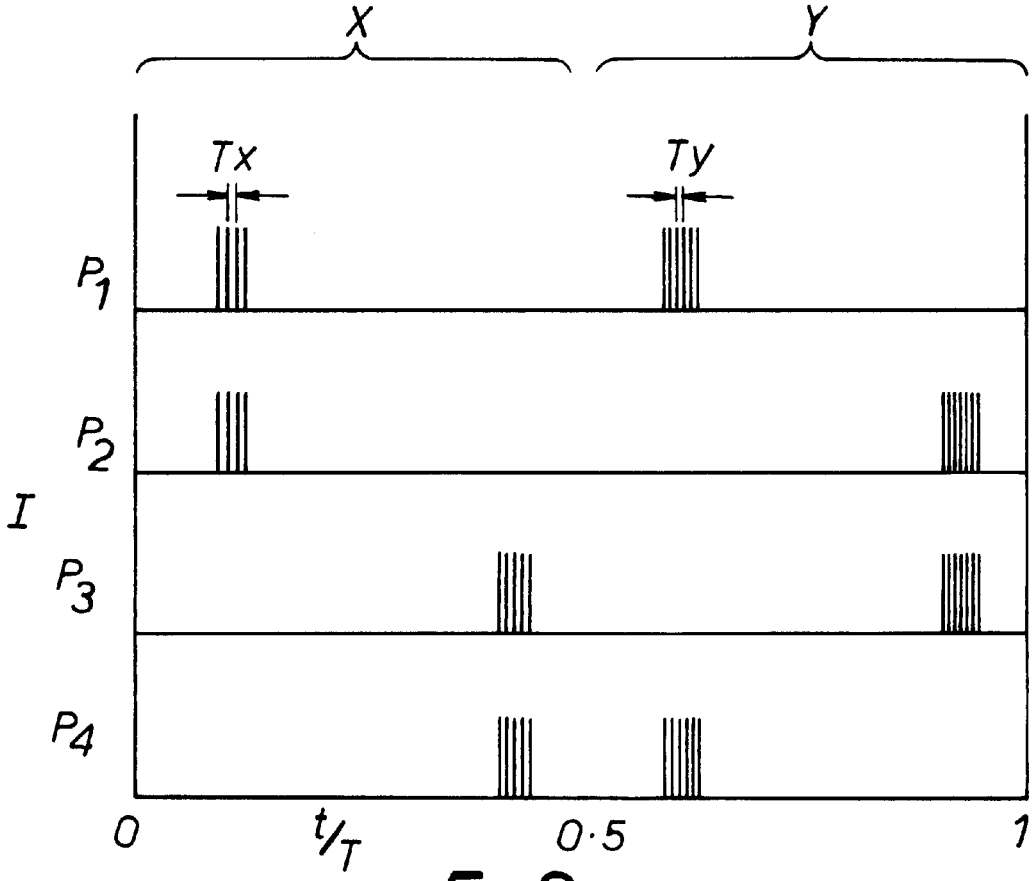
FIG. 8 is a graph of received beam intensity of the beam components shown in FIG. 7 against time, expressed as one scan cycle of the two beam components, for the four points shown in FIG. 7, the graph indicating the form of the beam as it is incident upon each of the four points.

FIG. 8 illustrates schematically the variation in a series of electromagnetic (laser) pulses received for various sensor positions ($P_1$, $P_2$, $P_3$, $P_4$) within the control beam.

Figure 9:
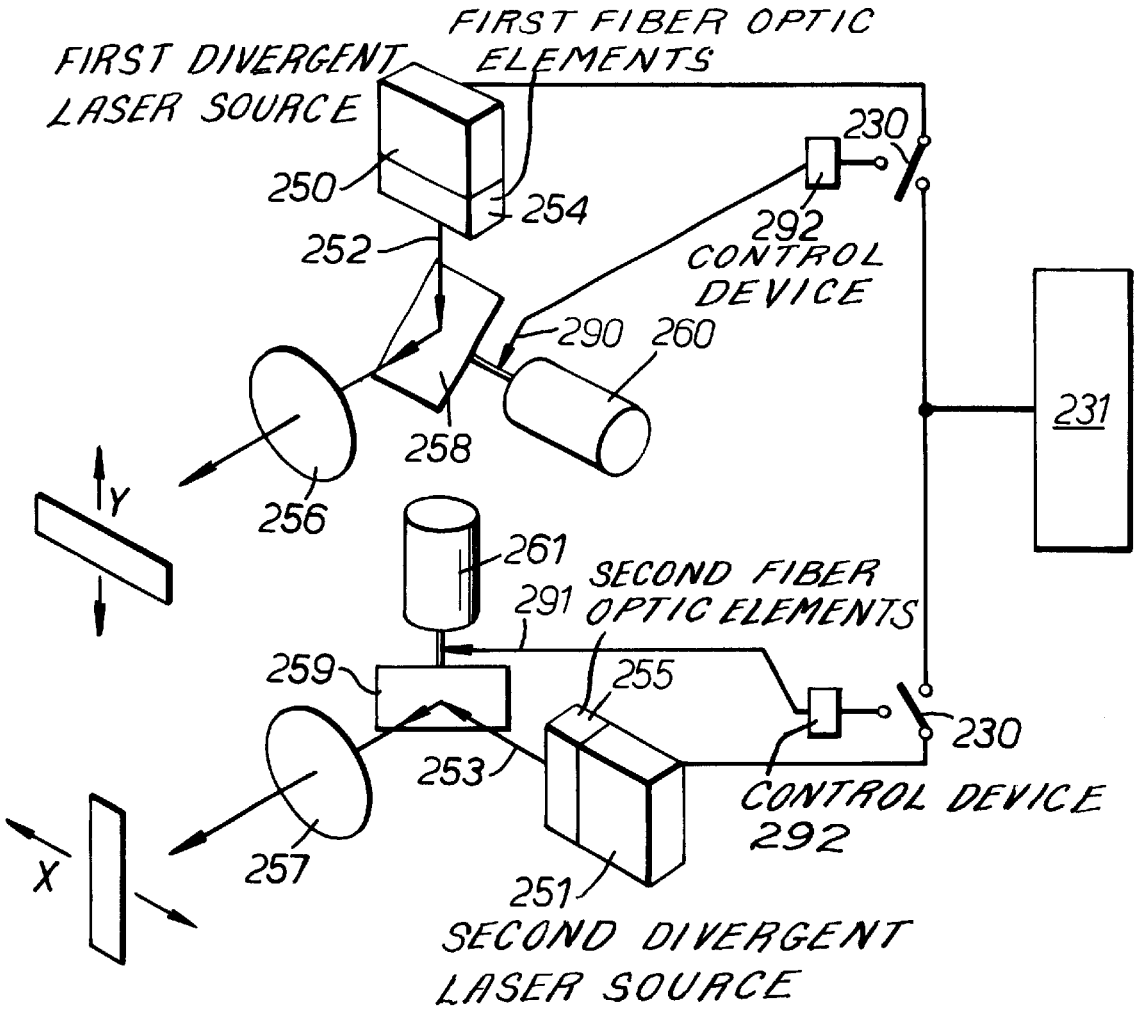
FIG. 9 is a schematic diagram of a generator for generating the beam of FIG. 7.
Figure 10:
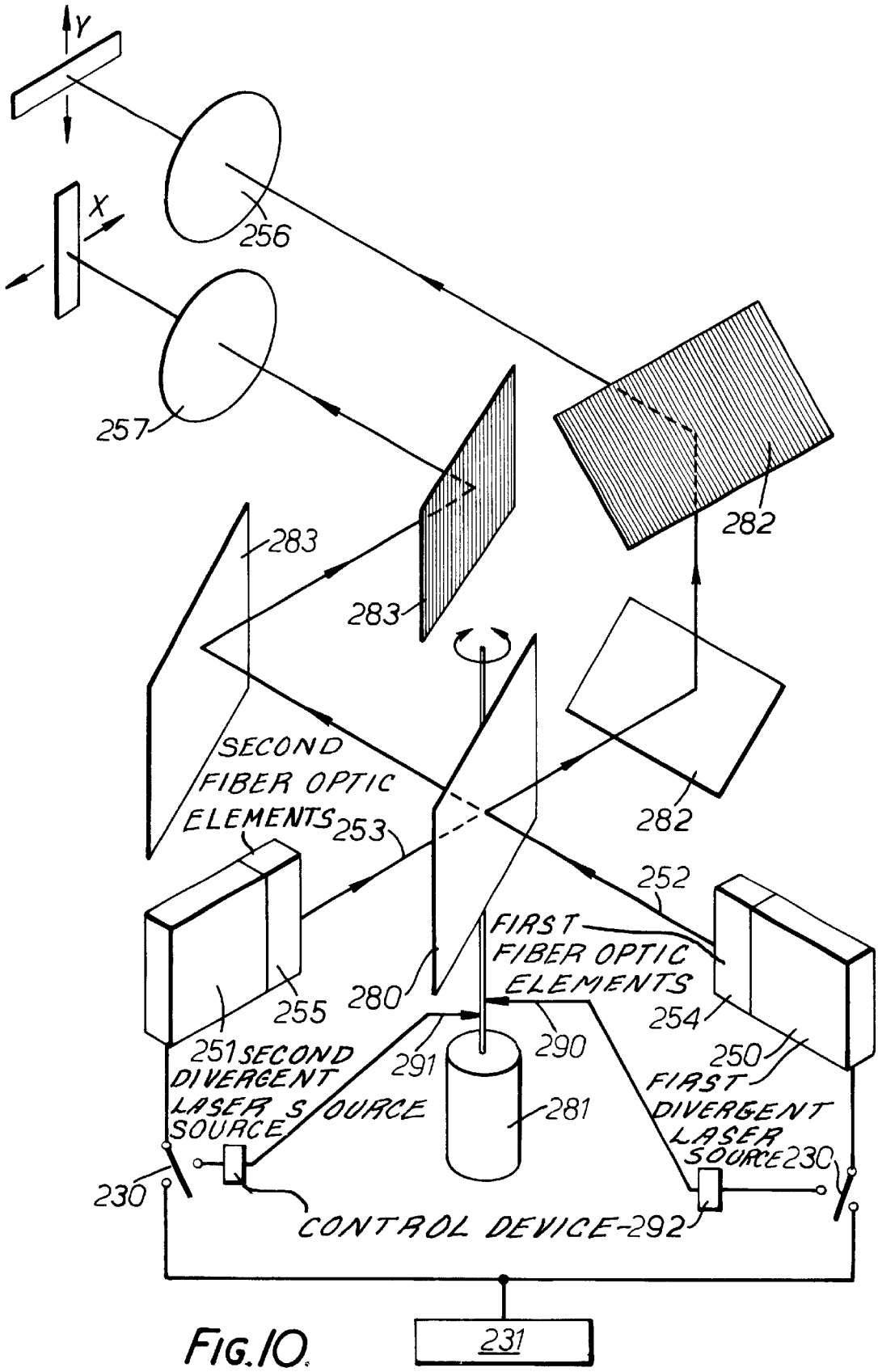
FIG. 10 is a diagram of an alternative generator for generating the beam of FIG. 7.

Generation of the control pattern by alternate sweeps of a rectangular shaped beam in orthogonal directions may be achieved by a variety of optical systems, for example, a single or double scanner, a single or double source and a single or double lens (i.e. aperture). FIGS. 9 and 10 respectively illustrate two optical arrangements selected from the range of possible scanner/source/lens combinations. The choice of arrangement for a particular application will be governed by overall system design considerations.

Referring to FIG. 9, the illustrated embodiment of optical beam transmitting apparatus comprises a first 250 and a second 251 divergent laser source (for example laser diodes) providing first 252 and second 253 laser beams which are coupled into first 254 and second 255 fibre optic elements possessing rectangular cross-section output faces. The divergent beams from the shaped rectangular sources then pass to a main optical system indicated by first 256 and second 257 lenses which focus the beams as required.

Alternatively (1) the diverging beams from the laser sources can be collimated by collimating lens systems, the collimated beams being partially diffused by diffusing plates or optical scrambler rods. The resultant substantially parallel beams are then passed through fixed rectangular shaped apertures to the main optical system or (2) the diverging beams can be both collimated and shaped by double cylindrical lens systems within the main optical system.

Arranged between the rectangular shaped sources 254 and 255 and the main optical system 256 and 257 or alternatively after the main focussing lenses 256 and 257 are first 258 and second 259 scanning mirrors which are driven by first 260 and second 261 torque or other motor so as to sweep the beam usually at a constant angular velocity alternatively in orthogonal directions about the control region.

FIG. 10 shows a modification in which a single, double sided, scanning mirror 280 replaces the two scanning mirrors 258 and 259, being driven by a single motor 281. After reflection at the mirror 280, the beam 252 is directed to the lens system 256 by a pair of mirrors 282, and the beam 253 by mirrors 283., Laser trigger mechanisms linked to the beam scanning systems pulse the appropriate laser as the beam is scanned. Each laser trigger consists of a 'pick-off' or sensor 290,291 which senses the position of the scanning mirror and feeds information thereon to a control device 292 which produces a pulsed output signal to trigger a solid state switch 230, in phase with the scanning mirror positions, intermittently connecting a source 231 of high power to the laser source to produce corresponding pulses of the laser beam. During each scan of the mirrors each control device 292 will produce a progressive increase or decrease in the time interval between pulses of the laser beam within upper and lower limits.

Figure 11:
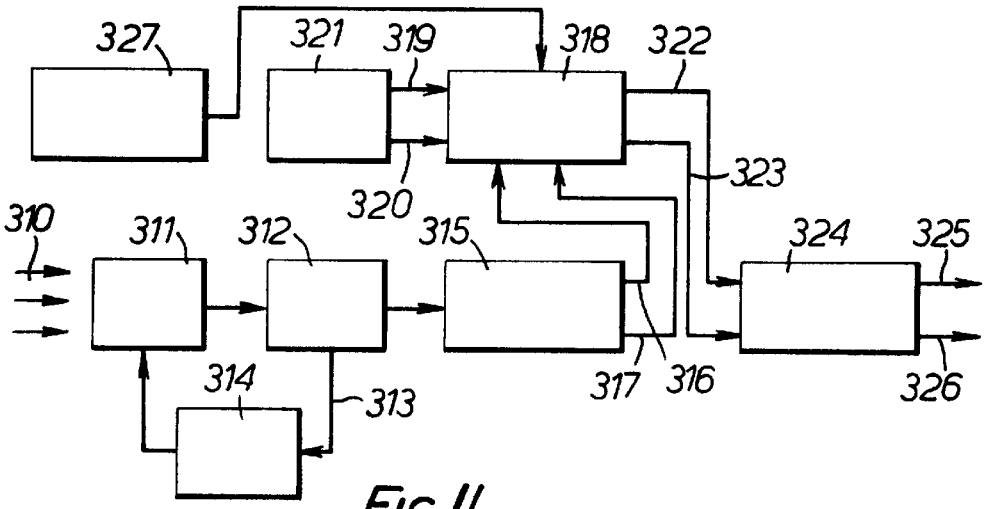
FIG. 11 is a block schematic diagram of a signal processing unit carried by each sub-missile for controlling the flight of the sub-missile.

Each of the sub-missiles 15 is provided with a guidance signal processing unit as illustrated schematically in FIG. 11. A modulated laser beam 310 transmitted from the laser generator shown in FIG. 6,9 or 10 is incident upon a detector 311 which generates a signal which provides an input to an amplifier 312. The signal gain provided by the amplifier is controlled automatically by a feedback path 313 through adaptive threshold means 314.

The output from the amplifier 312 is fed to data processing circuitry 315 which computes what is the position of the detector 311 within the cross-section of the modulated beam 310. The position, as expressed in polar or cartesian co-ordinates, appears as a pair of analogue or digital output signals fed as first and second inputs, along paths 316 and 317, to a comparator 318 which receives as third and fourth inputs compatible with the first and second inputs a further pair of signals along paths 319 and 320 from a reference origin store 321. The store 321 is programmed with positional information about the particular station which the sub-missile is to take up within the beam 310, and provides that information to the comparator 318 as a reference origin.

The comparator 318 feeds along paths 322 and 323 to a guidance processor 324 signals representative of the instantaneous positional error between the detector 311 and the aforesaid station which the sub-missile is required to attain. The guidance processor 324 computes what actuating signals should be fed to a flight direction control means of the sub-missile and provides these signals at outputs 325 and 326. The comparator 318 receives as a further input a signal from a range compensator 327, the purpose of which is explained below.

The above-described circuitry constitutes a guidance loop which serves to maintain each of the plurality of sub-missiles on its own reference origin, spaced from the other sub-missiles. The reference origin store 321 may be programmed during manufacture of the sub-missile but this has as one disadvantage that the sub-missiles which issue from the manufacturing process are not identical with one another because they are programmed differently from one another. To simplify assembly of sub-missiles and subsequent handling it is preferable to program the sub-missiles only after the step of installing them within a launcher.

One way of achieving this is to provide an umbilical connection between each of the sub-missiles 15 and the launcher for the bus missile 10. As part of a pre-launch timetable of events, each sub-missile 15 receives a different signal along the umbilical which programs the respective origin store 321 with positional information defining its own specific station within the beam.

Figure 12:
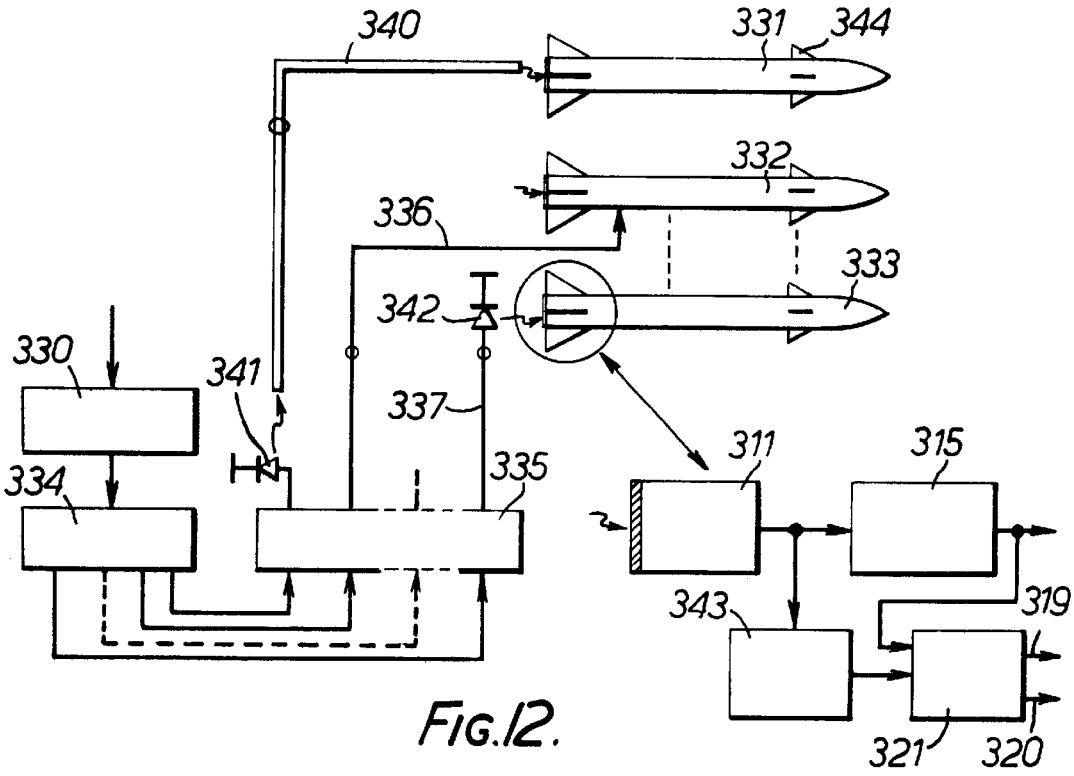
FIG. 12 is a block schematic diagram of a programming unit for programming the signal processing unit illustrated in FIG. 11.

Thus, as shown in FIG. 12, a fire control unit 330 is provided for the bus missile launcher with umbilical connections shown to only three of the sub-missiles 15, namely, sub-missiles 331,332 and 333. The fire control unit 330 actuates a sequencer 334 which controls the output from a launcher reference origin store 335 in such a way that a signal representative of the station which sub-missile 332 is to attain is fed along umbilical 336 to that sub-missile, and similarly, signals indicative of different stations are fed along other umbilicals to the remaining sub-missiles. For reasons of clarity, umbilicals to sub-missiles 331 and 333 are not shown.

Alternatively, the launcher could be provided with a set of radiation generators, for example, light-emitting diodes (LED's), one for each of the detectors, and so located that the radiation they generate is incident upon the detector with which they are each associated, the generators being actuated by the store 335.

Thus, in FIG. 12, sub-missile 331 has a detector (not shown) on its rear face and opposed to it is one end of a fibre-optic light path 340, the other end of which receives radiation generated by an LED 341 actuated by the reference origin store 335. The information contained in the radiation is "strobed" into the reference address store 321 in the sub-missile and used as the guidance datum during flight. One advantage of such an assembly is the avoidance of any physical connection between the sub-missiles and the launcher circuitry.

FIG. 12 also shows how a radiation generator, being an LED 342, may be positioned so that the detector 311 of one of the sub-missiles 333 receives the emitted radiation directly rather than after transmission along a fibre optic light path.

As FIG. 12 shows, the sub-missiles 331, 332 and 333 each contain control logic 343 which, in response to a signal received from the launcher reference origin store 335, programs the reference origin store 321 within the sub-missile. FIG. 12 also shows canard control surfaces 344 on the sub-missiles, these being actuated by the signals at the outputs 325 and 326 in flight of the sub-missiles in a manner with which those skilled in the art will be familiar.

Programming of the sub-missiles 15 to take up particular positions within the beam could be accomplished after launch rather than prior to launch, as follows. A cluster of identical sub-missiles 15 launched simultaneously would each be provided with means for comparing their instantaneous position with a series of available stations and for selecting as the station to be attained one of the available stations, in accordance with defined rules. In a simple case of a cluster of four sub-missiles, launched in such manner that, immediately after launch, each will occupy a different one of the four quadrants of the cross-section of the guidance beam, each sub-missile has a reference origin store 321 which defines four stations, one in each quadrant, and circuitry for selecting as the station to be attained, the station in the same quadrant as the detector of the sub-missile is located at that instant of time. Again, with this technique, a uniform, standard sub-missile and incorporated electronics pack is specified for manufacture.

The sub-missile laser guidance beam will normally have a tendency to diverge, and this would have the effect of increasing the transverse distance between the sub-missiles of the cluster with increasing range from the beam source. The purpose of the range compensator 327 mentioned above is to modify the output from the comparator 318 so as to maintain the dimensions of the sub-missile cluster with increasing range in a diverging beam. Alternatively, the compensator 327 could be arranged to modify progressively the co-ordinates of the reference origin in store 321 over the flight of the sub-missile.

The sub-missiles 15, in the embodiment of the invention specifically described, are unpowered in the sense that they contain no propulsion motors. Furthermore, the warhead is provided as a high kinetic energy mass of tungsten heavy alloy. It will however be appreciated that power-driven sub-missiles could be used and the warhead could be provided with a small explosive charge.

The sub-missiles 15 nevertheless need to be guided and flight direction control is provided by the use of aerodynamic canard control surfaces. A sub-missile having such control surfaces will now be described with reference to FIGS. 13 and 14.

Figure 13:
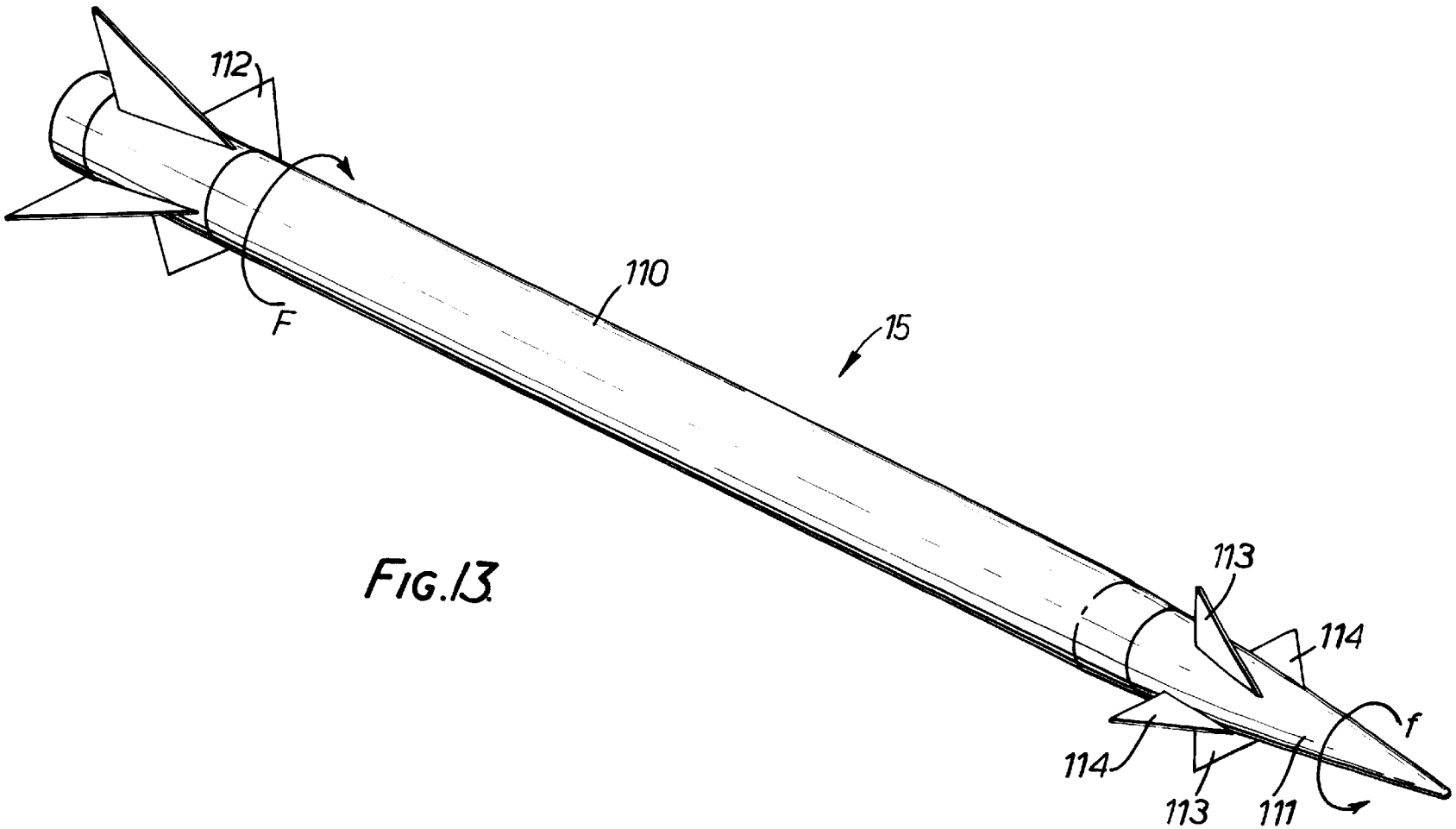
FIG. 13 is a schematic perspective view of a sub-missile carried by the bus missile shown in FIG. 1 drawn to an enlarged scale.

FIG. 13 shows a sub-missile 15 having a body 110 and a nose section 111. Four main flight surfaces 112 are provided at the rear of the body 110 and are so oriented that the body 10 has a tendency to rotate in a clockwise direction (viewed from the front of the sub-missile) during normal flight, as indicated by arrow F.

A nose section 111 of the sub-missile is freely rotatable relative to the body portion 110 about the longitudinal axis of the sub-missile. It carries a pair 113 of fixed ailerons at opposite ends of a transverse diameter of the nose, these giving the nose 111 a tendency to rotate in normal flight in a direction shown by arrow f counter to that of the body portion 110 in normal flight. A pair of elevators 114 fixed on the nose section at a small angle of incidence and located at opposite ends of a diameter transverse to that containing the ailerons 113 imposes on the sub-missile a transverse force i.e. one in direction transverse to that of its flight. During such time as the rotation of the nose 111 is free there is no resultant unidirectional transverse steering force on the sub-missile. However, when the free rotation is interrupted, the resultant force will accelerate the missile in a direction transverse to its length.

It will be appreciated from the foregoing that flight of the missile is controlled in canard fashion.

Figure 14:
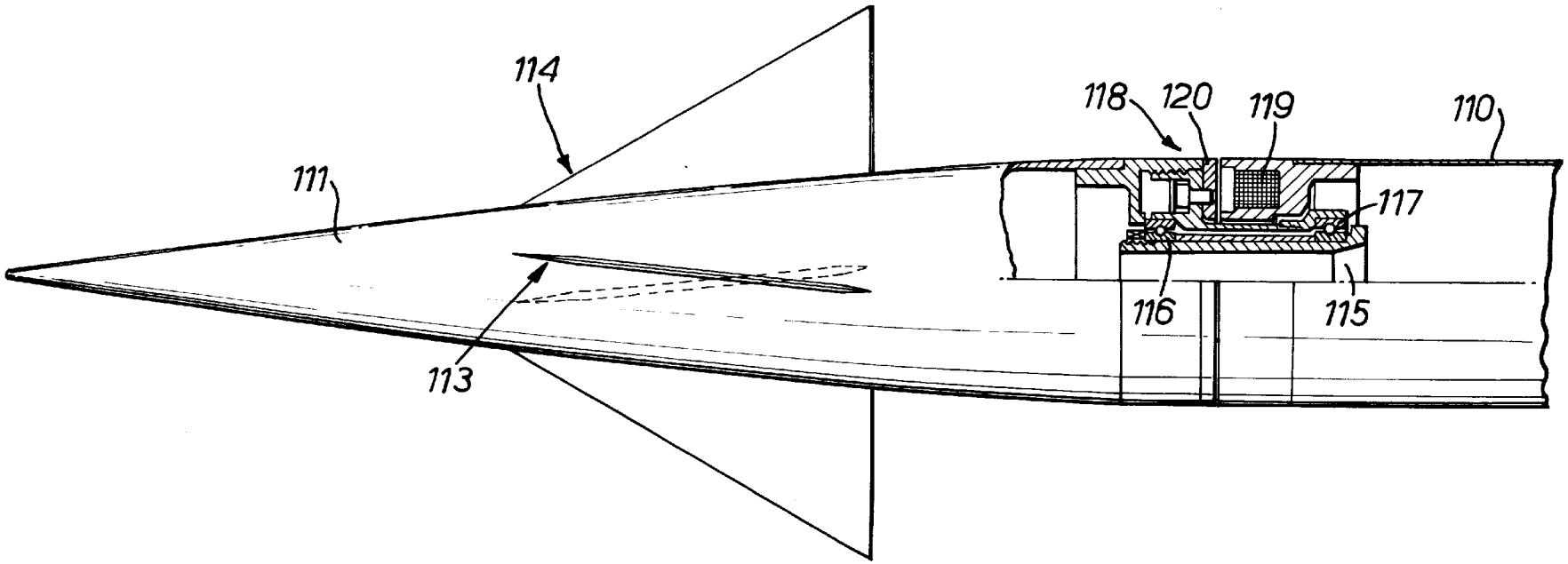
FIG. 14 is a schematic side view of a forward part of the sub-missile shown in FIG. 13, partly cut away.

FIG. 14 shows in somewhat more detail the connection of the nose 111 and the body 110. An axial shaft 115 of the nose extends rearwardly into the body 110 and is carried therein by a forward ball race 116 and a rearward ball race 117. A conventional electromagnetic clutch, referenced generally 118, is employed to interfere with free rotation of the nose 111 relative to the body 110 in a manner known per se. The clutch 118 comprises an annular coil 119 through which an electric current flows to generate an electromagnetic field which interacts with an armature 120 on the nose 111 to resist rotation of the nose 111 relative to the coil 119. Electrical current is supplied to the coil 119 from a flight direction control circuit, not shown in FIG. 10, which varies this current with time in such a way as to interfere with the free rotation of the nose at times when a steering correction of the sub-missile is required. This interference introduces a disparity between the length of time which the elevator surfaces 114 occupy in one angular position of the nose and the time during which they occupy other angular positions i.e. it biases the elevators towards a selected angular position thereby to direct the sub-missile transversely as necessary to correct the path of its flight. In the limiting case, the current through the coil is such as to maintain the angular position of the nose fixed in relation to the environment of the sub-missile for long enough to achieve the necessary steering connection.

The sub-missile illustrated in FIGS. 13 and 14 is guided by the pulsed laser beam generated from the bus missile.

The bus missile 10 is initially guided during its mid-course flight to the target under command guidance control which demands steering corrections effected by canard control surfaces carried by the nose portion 11. It will be appreciated that although the bus missile 10 can be guided in any one of a number of different ways using canard control surfaces, the fact that the sub-missile laser guidance beam generator 14 is mounted in the nose portion 11 makes it advantageous to roll stabilise the nose portion 11 in space and employ two pairs of canard control surfaces for steering the bus missile in its pitch and yaw planes simultaneously. To this end a first pair of control surfaces 9 as shown in FIG. 1 are provided in a vertical plane to effect yaw steering movements of the bus missile and a further pair of control surfaces arranged in a plane at right angles to that containing the surfaces 9 for controlling pitch movements of the bus missile 10. The roll stabilisation of the nose portion 11 can readily be obtained by biasing the canard control surfaces on the nose portion 11 to tend to rotate the nose portion in a direction opposite to that of the body portion 12 and applying braking means for braking the nose portion 11 relative to the body portion 12 to bring the nose portion 11 into a fixed roll attitude in space under the control of signals developed by a free gyroscope mounted within the nose portion 11.

Spinning of the body portion 12 of the bus missile 10 is achieved by appropriately inclining stabilising fins 8 carried by the body portion 12.

It will be appreciated that in an anti-missile engagement where no defences are likely to be mounted the bus missile can be flown to within comparatively short range of the target, whereas in an anti-ship engagement the bus missile should be outside the range of the defensive system when the sub-missiles are released.

What is claimed is:

1. A missile system comprising a bus missile, bus missile guidance means for guiding the bus missile toward a target from a launch station remote from the target, a plurality of sub-missiles carried by the bus missile, sub-missile launch means to launch the sub-missiles from the bus missile during flight of the bus missile whereby they deploy ahead of the bus missile and a sub-missile guidance beam generating means within the bus missile for generating and transmitting a sub-missile guidance beam to guide the sub-missiles to the target.

2. A system according to claim 1, wherein the sub-missiles are guided to the target by the sub-missile guidance beam in a predetermined but variable spatial pattern.

3. A system according to claim 1, wherein the bus missile includes a sustainer motor for sustaining flight of the bus missile to the target.

4. A system according to claim 3, wherein the sustainer motor of the bus missile is such as to bring the bus missile to and sustain it at a predetermined low supersonic speed.

5. A system according to claim 1, wherein the bus missile includes a booster motor for accelerating the bus missile during a final acceleration phase when it closes to a predetermined range from the target.

6. A system according to claim 5, wherein the booster motor is such as to accelerate the bus missile during the final acceleration phase to a speed of at least twice the mid-course speed.

7. A system according to claim 5, wherein the sub-missile launch means is operative to launch the sub-missiles at the end of the final acceleration phase.

8. A system according to claim 5, wherein flight direction control means of the bus missile are made responsive to a predetermined control signal to cause the bus missile to climb to an increased altitude during the final acceleration phase and wherein the sub-missiles are launched at the increased altitude and on a rising trajectory.

9. A system according to claim 1, wherein each sub-missile includes flight direction control means, wherein the sub-missile guidance beam is a pulsed laser beam providing a scan with repsect to a scan axis coincident with the longitudinal axis of the bus vehicle and extending forwardly thereof to provide within an area scanned by the beam a pulse modulation sufficient to identify coordinates of any point within the scanned area and wherein each sub-missile includes a receiver for generating control signals for application to the flight direction control means of the sub-missile to bring the sub-missile to a selected one of a plurality of spaced sub-missile stations within the scanned area.

10. A system according to claim 9, wherein the sub-missile flight direction control means includes aerodynamic control surfaces responsive to the control signals generated in the sub-missile receiver.

11. A system according to claim 1, wherein the bus missile comprises a body portion which is caused to rotate during flight, wherein the sub-missiles are mounted on the body portion of the bus missile and wherein the sub-missiles upon release at launch deploy radially outwardly from the body portion under centrifugal force.

12. A system according to claim 1, wherein each sub-missile is a guided non-power-driven sub-missile.

13. A system according to claim 12, wherein the drag characteristic of each sub-missile relative to the drag characteristic of the bus missile is such that the sub-missile when launched from the bus missile deploys ahead of the bus missile.

14. A system according to claim 1, wherein the bus missile guidance means comprises command guidance means located at the bus missile launch station for mid-course flight guidance of the bus missile to the target.

15. A system according to claim 14, wherein homing guidance means is provided for terminal guidance of the bus missile.

16. A system according to claim 11, wherein the bus missile includes a nose portion rotatable with respect to the body portion and roll attitude control means for controlling the roll attitude of the nose portion during flight of the bus missile.

17. A system according to claim 16, wherein the roll attitude control means is operative to maintain the nose portion roll stabilised in flight.

18. A system according to claim 16, wherein the sub-missile guidance beam generating means is located within the nose portion of the bus missile.

19. A system according to claim 15, wherein the bus missile includes a nose portion rotatable with respect to the body portion and roll attitude control means for controlling the roll attitude of the nose portion during flight of the bus missile, wherein the roll attitude control means is operative to maintain the nose portion roll stabilised in flight and wherein the homing guidance means is located in the nose portion of the bus missile.

20. A system according to claim 1, wherein the bus missile carries a launch motor which provides launch thrust and which separates from the bus missile when exhausted.

21. A method of missile guidance comprising the steps of launching a bus missile from a launch station remote from a target with the bus missile carrying a plurality of sub-missiles, launching the sub-missiles from the bus missile during flight of the bus missile whereby the sub-missiles deploy ahead of the bus missile and guiding the sub-missiles to the target under the control of a guidance beam generated in and transmitted from the bus missile.

22. A method according to claim 21, wherein the sub-missiles are guided to the target by the sub-missile guidance beam in a predetermined but variable spatial pattern.

23. A method according to claim 21, wherein the bus missile is sustained during mid-course flight at a predetermined low supersonic speed and is accelerated during a final acceleration phase to a speed of at least twice the mid-course speed when it closes to a predetermined range from the target.

24. A method according to claim 23, wherein the sub-missiles are launched from the bus missile upon completion of the final acceleration phase of the bus missile.

25. A method according to claim 23, wherein the bus missile is caused to climb to an increased altitude during the final acceleration phase and the sub-missiles are launched at the increased altitude.

26. A method according to claim 25, wherein the sub-missiles are launched on a rising trajectory.

27. A method according to claim 21, wherein each sub-missile is a guided unpowered projectile having a drag characteristic which is such in relation to the drag characteristic of the bus missile that when the sub-missile is launched from the bus missile it deploys ahead of the bus missile.

* * * * *